US012611057B1

(12) United States Patent
Gatten

(10) Patent No.: US 12,611,057 B1
(45) Date of Patent: Apr. 28, 2026

(54) BEDSHEET SECURING DEVICE

(71) Applicant: Dennis Gatten, Alton, IL (US)

(72) Inventor: Dennis Gatten, Alton, IL (US)

( * ) Notice: Subject to any disclaimer, the term of this patent is extended or adjusted under 35 U.S.C. 154(b) by 0 days.

(21) Appl. No.: 19/175,658

(22) Filed: Apr. 10, 2025

(51) Int. Cl.
*A47G 9/04* (2006.01)

(52) U.S. Cl.
CPC ..... *A47G 9/04* (2013.01)

(58) Field of Classification Search
CPC ..... A47C 21/00; A47C 21/02; A47C 21/022; A47C 21/024; A47C 21/026; A47C 21/028; A47C 21/06; A47G 9/04
See application file for complete search history.

(56) References Cited

U.S. PATENT DOCUMENTS 2,216,876 A * 10/1940 Crum ..... A47C 21/00 24/72.5
2,281,736 A * 5/1942 Wittenburg ..... A47C 21/028 81/488
2,556,913 A * 6/1951 Gilbert ..... A47C 21/00 5/513
5,867,873 A * 2/1999 Arend ..... A47C 1/143 24/326
6,044,526 A * 4/2000 Putney ..... A44B 99/00 24/17 AP
6,557,194 B1 * 5/2003 Jeffries ..... A47C 21/022 24/72.5
9,549,625 B1 * 1/2017 Wilkinson ..... A47G 9/0223
2018/0317674 A1 * 11/2018 Richard ..... A47G 9/0223
2019/0298006 A1 * 10/2019 Dagostino ..... A44B 1/32
2020/0022512 A1 * 1/2020 Glavin ..... A47G 9/0223

* cited by examiner

*Primary Examiner* — George Sun
(74) *Attorney, Agent, or Firm* — The Iwashko Law Firm, PLLC; Lev Ivan Gabriel Iwashko

(57) ABSTRACT

A bedsheet securing device to secure a bedsheet to a mattress, the bedsheet securing device including a wire portion, including a stem having an elongated shape, and a corkscrew portion having a corkscrew shape with either a pointed or a rounded end, the corkscrew portion being disposed at a first end of the stem, and a knob configured to be disposed at a second end of the stem, the knob including a knob main body having a substantially round shape, wherein the securing of the bedsheet to the mattress is performed by a user grabbing the knob main body with fingers of the user, placing the corkscrew portion firmly on a surface of the bedsheet, and then twisting the knob main body while applying pressure downward toward the bedsheet, thereby effectively screwing the corkscrew portion through the bedsheet and into the mattress, thus securing the bedsheet to the mattress.

3 Claims, 4 Drawing Sheets

BEDSHEET SECURING DEVICE

BACKGROUND

1. Field

The present general inventive concept relates generally to a securing device, and particularly, to a bedsheet securing device.

2. Description of the Related Art

Many people experience frustration when sheets and blankets slide off during the night as it causes discomfort and disrupts sleep.

The persistent problem of sheet slippage on mattresses is challenging to remedy as even fitted sheets are unreliable, at times, due to bed positioning or other factors.

Therefore, there is a need for a device that secures a bedsheet to a mattress.

SUMMARY

The present general inventive concept provides a bedsheet securing device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a bedsheet securing device to secure a bedsheet to a mattress, the bedsheet securing device including a wire portion, including a stem having an elongated shape, and a corkscrew portion having a corkscrew shape with either a pointed or a rounded end, the corkscrew portion being disposed at a first end of the stem, and a knob configured to be disposed at a second end of the stem, the knob including a knob main body having a substantially round shape, wherein the securing of the bedsheet to the mattress is performed by a user grabbing the knob main body with fingers of the user, placing the corkscrew portion firmly on a surface of the bedsheet, and then twisting the knob main body while applying pressure downward toward the bedsheet, thereby effectively screwing the corkscrew portion through the bedsheet and into the mattress, thus securing the bedsheet to the mattress.

The wire portion may further include a head disposed at the second end of the stem to couple to the knob, the head having at least one of a rounded shape and an ovular shape.

The knob may further include a knob protrusion disposed at a bottom portion or a bottom surface of the knob main body, wherein the knob protrusion extends perpendicularly away from the bottom surface of the knob main body, and a head receiving aperture disposed at a center portion of the knob protrusion to receive the head therein.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1:
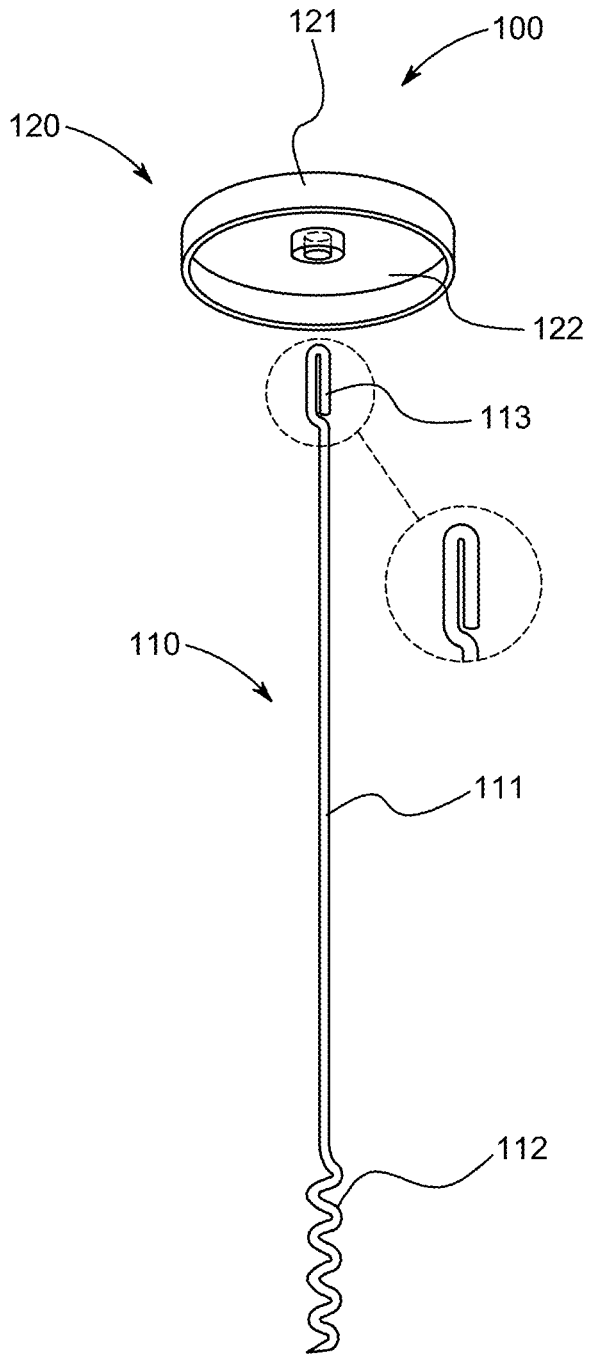
FIG. 1 illustrates a front angled perspective view of a bedsheet securing device, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Bedsheet Securing Device 100
Wire Portion 110

Stem 111
Corkscrew Portion 112
Head 113
Knob 120
Knob Main Body 121
Knob Protrusion 122
Head Receiving Aperture 123
Bedsheet Securing Device 200
Wire Portion 210
Stem 211
Corkscrew Portion 212
Head 213
Knob 220
Knob Main Body 221
Knob Protrusion 222
Head Receiving Aperture 223
Bedsheet Securing Device 300
Wire Portion 310
Stem 311
Corkscrew Portion 312
Knob 320
Knob Main Body 321
Knob Main Body Slot 322
Stem Receiving Protrusion 323
Bedsheet Securing Device 400
Wire Portion 410
Stem 411
Corkscrew Portion 412
Knob 420
Knob Main Body 421
Knob Center Portion 422

FIG. 1 illustrates a front angled perspective view of a bedsheet securing device 100, according to an exemplary embodiment of the present general inventive concept.

The bedsheet securing device 100, and all components therein, may be constructed from at least one of metal, plastic, paper, cotton, metal, silicone, liquid, fibers, threads, fabric, foam, sponge, feathers, circuitry, glass, and rubber, etc., but is not limited thereto, and can be constructed from any material known to one of ordinary skill in the art.

The bedsheet securing device 100 may secure any type of bedsheet, cover, quilt, comforter, etc. to any type of mattress known to one of ordinary skill in the art.

As illustrated in FIG. 1, the bedsheet securing device 100 may include a wire portion 110 and a knob 120, but is not limited thereto.

The wire portion 110 may include a stem 111, a corkscrew portion 112, and a head 113, but is not limited thereto.

The knob 120 may include a knob main body 121, a knob protrusion 122, and a head receiving aperture 123, but is not limited thereto.

The corkscrew portion 112 may have a shape of a corkscrew having either a rounded or a pointed end point, and may be attached to a first end of the stem 111.

The head 113 may be a rounded extension of the stem 111 having a rounded or ovular shape, and may be disposed at a second end of the stem 111 opposite from the first end of the stem 111.

The knob main body 121 may have a rounded shape having a flat top surface (i.e., similar to a top of a barstool), and may include the knob protrusion 122 disposed on a substantially center portion of a bottom surface of the knob main body 121 to extend perpendicularly away from the bottom surface of the knob main body 121. The knob protrusion 122 may have a rounded and/or ovular shape including the head receiving aperture 123 disposed at a substantially center portion of the knob protrusion 122, such that head receiving aperture 123 is configured to securely receive the head 113 therein. As such, the top surface of the knob main body 121 is configured to be perpendicular with respect to the stem 111 when the knob main body 121 is attached to the head 113.

Thus, a user may secure a bedsheet to a mattress (i.e., a mattress upon which the bedsheet is disposed) by grabbing the knob main body 121 with the user's fingers, placing the corkscrew portion 112 firmly on a surface of the bedsheet, and then twisting the knob main body 121 while applying pressure downward toward the bedsheet, thereby effectively screwing the corkscrew portion 112 through the bedsheet and into the mattress, thus securing the bedsheet to the mattress.

Figure 2:
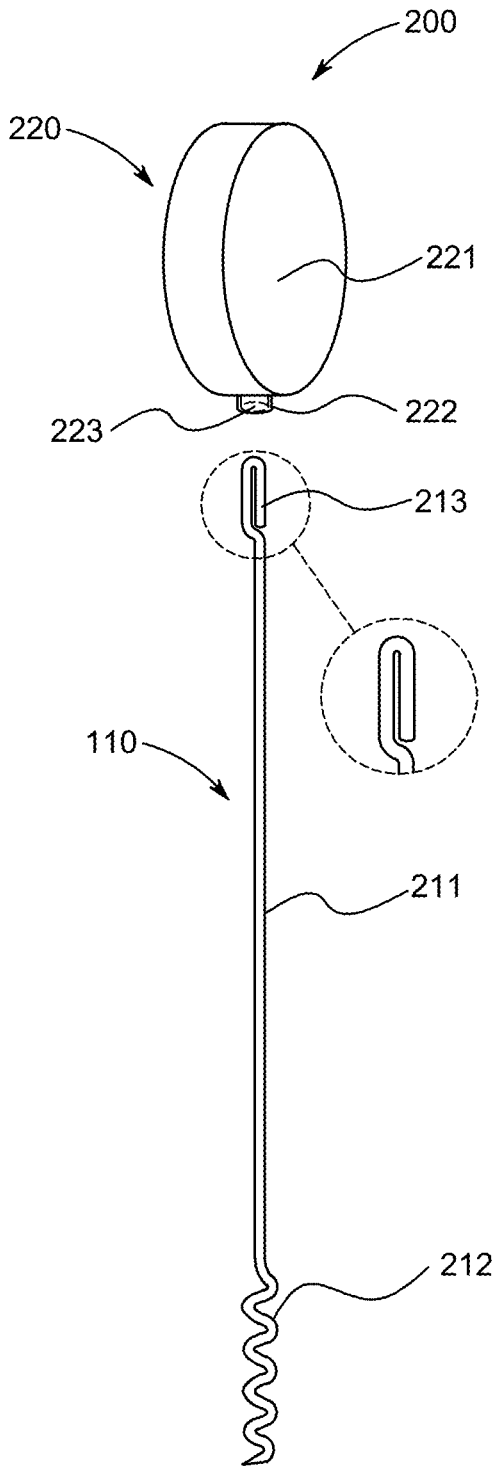
FIG. 2 illustrates a front angled perspective view of a bedsheet securing device, according to another exemplary embodiment of the present general inventive concept.

FIG. 2 illustrates a front angled perspective view of a bedsheet securing device 200, according to another exemplary embodiment of the present general inventive concept.

As illustrated in FIG. 2, the bedsheet securing device 200 may include a wire portion 210 and a knob 220, but is not limited thereto.

The wire portion 210 may include a stem 211, a corkscrew portion 212, and a head 213, but is not limited thereto.

The knob 220 may include a knob main body 221, a knob protrusion 222, and a head receiving aperture 223, but is not limited thereto.

The corkscrew portion 212 may have a shape of a corkscrew having either a rounded or a pointed end point, and may be attached to a first end of the stem 211.

The head 213 may be a rounded extension of the stem 211 having a rounded or ovular shape, and may be disposed at a second end of the stem 211 opposite from the first end of the stem 211.

The knob main body 221 may have a rounded shape having a flat side surfaces (i.e., the rounded shape is vertically situated, as depicted in FIG. 2), and may include the knob protrusion 222 disposed on a bottom surface of the knob main body 221 to extend perpendicularly away from the bottommost surface of the rounded portion of the knob main body 221. The knob protrusion 222 may have a rounded and/or ovular shape including the head receiving aperture 223 disposed at a substantially center portion of the knob protrusion 222, such that head receiving aperture 223 is configured to securely receive the head 213 therein. As such, the side surfaces of the knob main body 221 are configured to be perpendicular with respect to the stem 211 when the knob main body 221 is attached to the head 213.

Thus, a user may secure a bedsheet to a mattress (i.e., a mattress upon which the bedsheet is disposed) by grabbing the knob main body 221 with the user's fingers, placing the corkscrew portion 212 firmly on a surface of the bedsheet, and then twisting the knob main body 221 while applying pressure downward toward the bedsheet, thereby effectively screwing the corkscrew portion 212 through the bedsheet and into the mattress, thus securing the bedsheet to the mattress.

Figure 3:
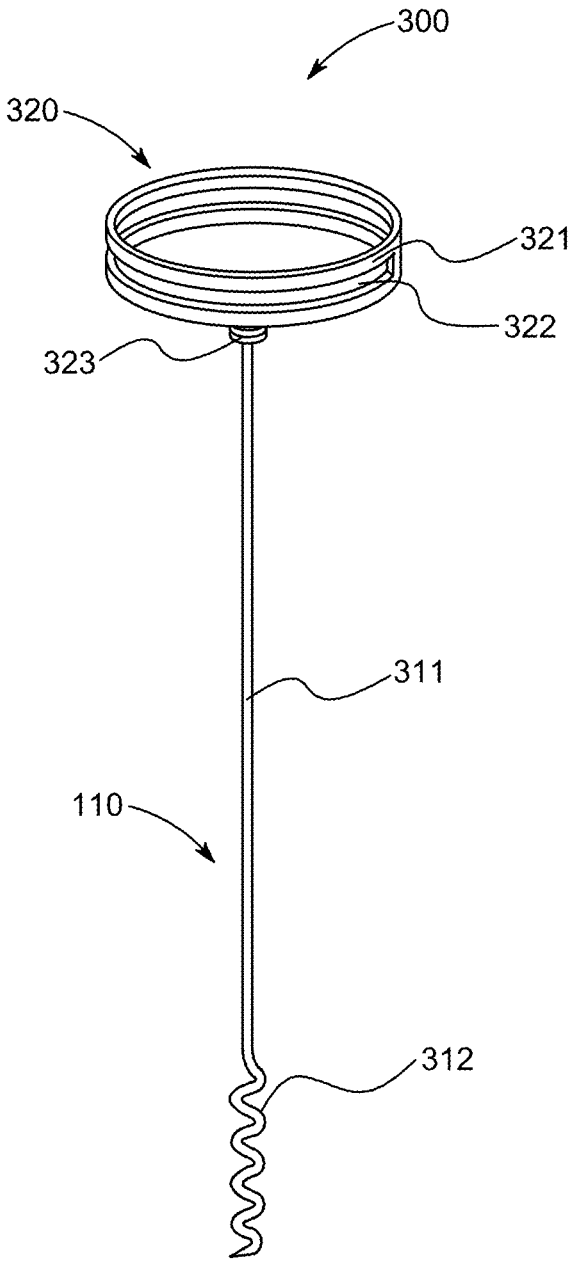
FIG. 3 illustrates a front angled perspective view of a bedsheet securing device, according to another exemplary embodiment of the present general inventive concept.

FIG. 3 illustrates a front angled perspective view of a bedsheet securing device 300, according to another exemplary embodiment of the present general inventive concept.

As illustrated in FIG. 3, the bedsheet securing device 300 may include a wire portion 310 and a knob 320, but is not limited thereto.

The wire portion 310 may include a stem 311, and a corkscrew portion 312, but is not limited thereto.

The knob 320 may include a knob main body 321, a knob main body slot 322, and a stem receiving protrusion 323, but is not limited thereto.

The corkscrew portion 312 may have a shape of a corkscrew having either a rounded or a pointed end point, and may be attached to a first end of the stem 311.

The stem 311 may have a second end, opposite from the first end of the stem 311, which is coupled to the stem receiving protrusion 323, which may be a protruding member extending perpendicularly from a bottom surface of the knob main body 321.

The knob main body 321 may have a rounded shape having a open area at a top portion thereof, and may include the stem receiving protrusion 323 disposed on a substantially center portion of the bottom surface of the knob main body 321 to extend perpendicularly away from the bottom surface of the knob main body 321.

The knob main body slot 322 may be an aperture disposed at least partially circumferentially around the knob main body 321, as illustrated in FIG. 3.

Thus, a user may secure a bedsheet to a mattress (i.e., a mattress upon which the bedsheet is disposed) by grabbing the knob main body 321 with the user's fingers, placing the corkscrew portion 312 firmly on a surface of the bedsheet, and then twisting the knob main body 321 while applying pressure downward toward the bedsheet, thereby effectively screwing the corkscrew portion 312 through the bedsheet and into the mattress, thus securing the bedsheet to the mattress.

Figure 4:
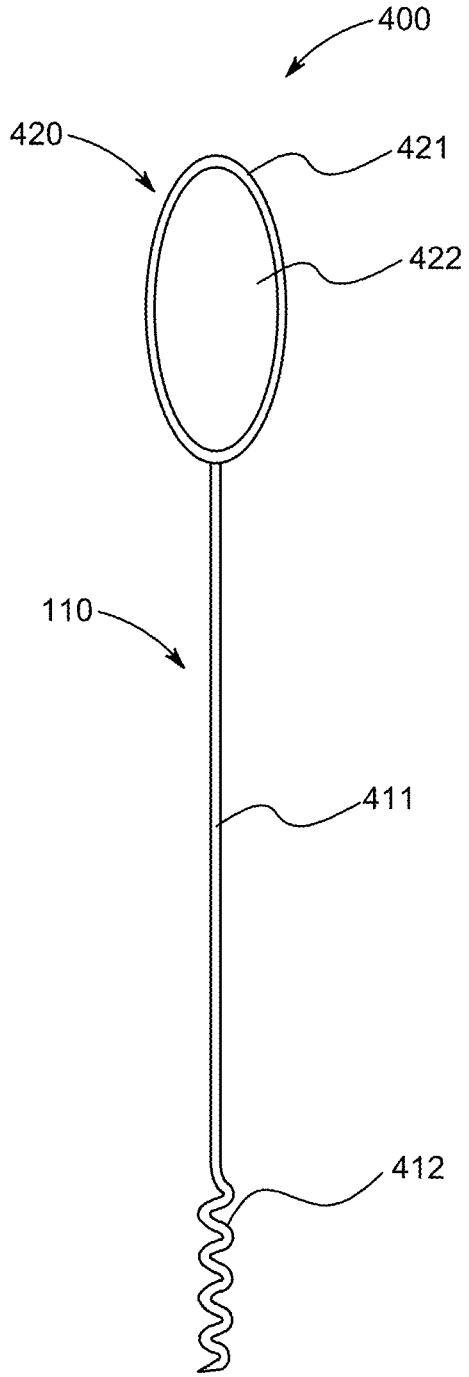
FIG. 4 illustrates a front angled perspective view of a bedsheet securing device, according to another exemplary embodiment of the present general inventive concept.

FIG. 4 illustrates a front angled perspective view of a bedsheet securing device 400, according to another exemplary embodiment of the present general inventive concept.

As illustrated in FIG. 4, the bedsheet securing device 400 may include a wire portion 410 and a knob 420, but is not limited thereto.

The wire portion 410 may include a stem 411, and a corkscrew portion 412, but is not limited thereto.

The knob 420 may include a knob main body 421, and a knob center portion 422, but is not limited thereto.

The corkscrew portion 412 may have a shape of a corkscrew having either a rounded or a pointed end point, and may be attached to a first end of the stem 411.

The stem 411 may have a second end, opposite from the first end of the stem 411, which may be coupled to a bottommost outer surface of the knob main body 221 such that the stem 411 extends away from the knob main body 221.

The knob main body 221 may have a rounded shape having a knob center portion that is an open area (i.e., a large aperture, as depicted in FIG. 4).

Thus, a user may secure a bedsheet to a mattress (i.e., a mattress upon which the bedsheet is disposed) by grabbing the knob main body 421 with the user's fingers, placing the corkscrew portion 412 firmly on a surface of the bedsheet, and then twisting the knob main body 421 while applying pressure downward toward the bedsheet, thereby effectively screwing the corkscrew portion 412 through the bedsheet and into the mattress, thus securing the bedsheet to the mattress.

The present general inventive concept may include a bedsheet securing device 100 to secure a bedsheet to a mattress, the bedsheet securing device 100 including a wire portion 110, including a stem 111 having an elongated shape, and a corkscrew portion 112 having a corkscrew shape with either a pointed or a rounded end, the corkscrew portion 112 being disposed at a first end of the stem 111, and a knob 120 configured to be disposed at a second end of the stem 111, the knob 120 including a knob main body 121 having a substantially round shape, wherein the securing of the bedsheet to the mattress is performed by a user grabbing the knob main body 121 with fingers of the user, placing the corkscrew portion 112 firmly on a surface of the bedsheet, and then twisting the knob main body 121 while applying pressure downward toward the bedsheet, thereby effectively screwing the corkscrew portion 112 through the bedsheet and into the mattress, thus securing the bedsheet to the mattress.

The wire portion 110 may further include a head 113 disposed at the second end of the stem 111 to couple to the knob 120, the head 113 having at least one of a rounded shape and an ovular shape.

The knob 120 may further include a knob protrusion 122 disposed at a bottom portion or a bottom surface of the knob main body 121, wherein the knob protrusion 122 extends perpendicularly away from the bottom surface of the knob main body 121, and a head receiving aperture 123 disposed at a center portion of the knob protrusion 122 to receive the head 113 therein.

A main purpose of the present general inventive concept is to prevent sheets and blankets from slipping off the mattress as one is resting, improving bed fabric management. Ingenious and practical, the present general inventive concept offers a modern accessory that ensures that bedding stays in place throughout the night, promoting better sleep and comfort while reducing the need for frequent readjustment of bedding. The present general inventive concept accomplishes this by securely anchoring the bedding to the mattress at multiple points using its corkscrew-shaped wire design and molded plastic knob. Whether placed at the four corner ends of a bed or used to secure mid-sections, this accessory burrows into the base of the bed effectively preventing sheet movement. Its design allows for straightforward insertion and removal making it accessible for users of all ages. Unlike alternatives, such as pins or adhesive tapes that may damage fabrics or surfaces over time, the present general inventive concept penetrates fabric without causing harm, effectively preserving the integrity of the materials it secures. The versatility of the present general inventive concept extends its functionality to help secure personal items, attach drapes, or fasten fabrics together, making it a multipurpose tool for household needs beyond just bedding retention. Designed to present a neat and organized appearance, throughout the home, the present general inventive concept serves as a practical tool for anyone looking to manage fabrics without causing damage or leaving unsightly marks. As a result, the present general inventive concept may prove beneficial to the household industry.

What sets the present general inventive concept apart is its ingenious design that effectively addresses the universal problem of sheet slippage with simplicity and efficiency by gently but securely gripping both the sheet and mattress fabric without causing damage. Its versatility extends beyond bedding, making it suitable for securing various fabrics around the home, ensuring a neat and organized environment without the hassle of constant readjustment. This unique combination of functionality, ease of use, and fabric-friendly design makes the present general inventive concept a standout solution for enhancing comfort and convenience in everyday living, making it an invaluable addition to any household seeking practical solutions for addressing varying needs.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A bedsheet securing device to secure a bedsheet to a mattress, the bedsheet securing device comprising:

a wire portion, comprising:

a stem having an elongated shape, and a corkscrew portion having a corkscrew shape with either a pointed or a rounded end, the corkscrew portion being disposed at a first end of the stem; and a knob configured to be disposed at a second end of the stem, the knob comprising:

a knob main body having a substantially round shape, wherein the securing of the bedsheet to the mattress is performed by a user grabbing the knob main body with fingers of the user, placing the corkscrew portion firmly on a surface of the bedsheet, and then twisting the knob main body while applying pressure downward toward the bedsheet, thereby effectively screwing the corkscrew portion through the bedsheet and into the mattress, thus securing the bedsheet to the mattress, and a head receiving aperture to receive a portion of the stem thereinside to allow the stem to couple to the knob, wherein the wire portion further comprises a head disposed at the second end of the stem to couple to the knob, the head having at least one of a rounded shape and an ovular shape.

2. A bedsheet securing device to secure a bedsheet to a mattress, the bedsheet securing device comprising:

a wire portion, comprising:

a stem having an elongated shape, and a corkscrew portion having a corkscrew shape with either a pointed or a rounded end, the corkscrew portion being disposed at a first end of the stem; and a knob configured to be disposed at a second end of the stem, the knob comprising:

a knob main body having a substantially round shape, wherein the securing of the bedsheet to the mattress is performed by a user grabbing the knob main body with fingers of the user, placing the corkscrew portion firmly on a surface of the bedsheet, and then twisting the knob main body while applying pressure downward toward the bedsheet, thereby effectively screwing the corkscrew portion through the bedsheet and into the mattress, thus securing the bedsheet to the mattress, a knob protrusion disposed at a bottom portion or a bottom surface of the knob main body, wherein the knob protrusion extends perpendicularly away from the bottom surface of the knob main body; and a head receiving aperture disposed at a center portion of the knob protrusion to receive the head therein.

3. A bedsheet securing device to secure a bedsheet to a mattress, the bedsheet securing device comprising:

a wire portion, comprising:

a stem having an elongated shape, and a corkscrew portion having a corkscrew shape with either a pointed or a rounded end, the corkscrew portion being disposed at a first end of the stem; and a knob configured to be disposed at a second end of the stem, the knob comprising:

a knob main body having a substantially round shape, wherein the securing of the bedsheet to the mattress is performed by a user grabbing the knob main body with fingers of the user, placing the corkscrew portion firmly on a surface of the bedsheet, and then twisting the knob main body while applying pressure downward toward the bedsheet, thereby effectively screwing the corkscrew portion through the bedsheet and into the mattress, thus securing the bedsheet to the mattress, wherein the wire portion further comprises a head disposed at the second end of the stem to couple to the knob, the head having at least one of a rounded shape and an ovular shape.

* * * * *